US006962296B2

(12) United States Patent
Hamel et al.

(10) Patent No.: US 6,962,296 B2
(45) **Date of Patent: *Nov. 8, 2005**

(54) STEAM WATER SPRAY SYSTEMS

(75) Inventors: Robert G. Hamel, Bowen Island (CA); Geoffrey Arthur Jones, Bowen Island (CA); Shizhong Duan, Coquitlam (CA)

(73) Assignee: ABB Ltd. (IE)

( * ) Notice: Subject to any disclaimer, the term of this patent is extended or adjusted under 35 U.S.C. 154(b) by 219 days.

This patent is subject to a terminal disclaimer.

(21) Appl. No.: 10/271,924

(22) Filed: Oct. 16, 2002

(65) Prior Publication Data

US 2004/0074981 A1 Apr. 22, 2004

(51) Int. Cl.[7] ..... B05B 17/04; B05B 7/10; B05B 7/06; F23D 11/16; D21F 11/00

(52) U.S. Cl. ..... 239/11; 239/400; 239/424.5; 239/422; 162/207

(58) Field of Search ..... 239/11, 518, 537, 239/400, 422, 424.5, 524, 270; 162/207, 204

(56) References Cited

U.S. PATENT DOCUMENTS 3,595,482 A * 7/1971 Jefferson-Loveday ..... 239/403
4,321,760 A * 3/1982 Meier ..... 34/638
4,946,101 A * 8/1990 Winheim ..... 239/8
5,829,274 A * 11/1998 Fleissner ..... 68/5 D
6,248,407 B1 * 6/2001 Hess ..... 427/426
6,394,418 B1 5/2002 Duan et al.
6,460,775 B1 10/2002 Duan et al.
6,613,195 B2 * 9/2003 Anderson ..... 162/289
6,699,365 B2 * 3/2004 Duan ..... 162/207
2003/0094254 A1 * 5/2003 Duan ..... 162/207
2003/0136861 A1 * 7/2003 Kangas et al. ..... 239/400

FOREIGN PATENT DOCUMENTS

DE 2925026 A1 1/1981

* cited by examiner

*Primary Examiner*—William C. Doerrler
(74) *Attorney, Agent, or Firm*—Michael M. Rickin, Esq.

(57) ABSTRACT

An apparatus and method to use steam to atomize water to produce a mixture of moisture and heat for application to the web of a paper machine for both production improvement and paper quality control. The method allows independent droplet size and heat control in the mixture, resulting in flexibility that can not be offered by conventional steam showers or water spray systems individually. In one embodiment the apparatus consists of a plurality of actuator nozzle modules which control the water volume flow feeding the nozzle through a pneumatic pressure signal. Pressurized steam feeding the nozzle is used to break the water into fine droplets. The resulting nozzle spray is a mixture of moisture in fine water droplets and steam vapor, and heat stored in the steam. Alternatively, a plurality of steam valves can be used to regulate the steam volume flow feeding each atomizing nozzle.

13 Claims, 4 Drawing Sheets

STEAM WATER SPRAY SYSTEMS

FIELD OF THE INVENTION

This invention relates to a method and apparatus to deliver both heat and moisture to a web of paper and more particularly to a method and apparatus for atomizing water with steam to improve the production and paper qualities of a papermaking machine.

DESCRIPTION OF THE PRIOR ART

In the modern production of paper, a continuous fiber/water slurry is formed as a moving web on a paper machine. As the slurry moves down the paper machine the water is removed to leave the fiber which forms the paper sheet.

The paper machine has several sections. The first section drains the water under the influences of gravity and vacuum on the Fourdrinier table. After the Fourdrinier table a web is produced with sufficient strength to be self-supporting to feed itself into a second or press section.

The second section of the paper machine presses the paper web and squeezes the water from the sheet. This section typically consists of a series of rolls forming press nips through which the paper web is fed. After pressing removes all the water that it can, the remaining moisture in the web must be evaporated.

The third section of the paper machine, normally referred to as the dryer, evaporates the remaining moisture in the paper web down to the final level desired for the grade of paper being produced.

At the end of the paper machine is a calender that adds gloss and smoothness to the paper surface. If the paper surface requires higher gloss and smoothness than that which can be achieved by the normal on-machine calendering then off-machine supercalendering is further applied to the paper surface.

During the production of paper it is important that a consistent quality be produced and maintained. The moisture profile in the cross-machine direction (CD) is one of many important qualities of paper products. It is not only important that the overall moisture level be controlled, but also that the moisture distribution throughout the sheet be controlled both in the direction that the sheet is moving known as the machine direction (MD) and in the CD. Variation in moisture content of the sheet will often affect paper quality as much or even more than the absolute moisture content.

There are numerous influences on the paper machine that can cause variation of the moisture content especially in the CD. Wet or dry edges and characteristic moisture profiles are common occurrences on paper machines. As with the moisture content of the sheet, similar problems exist for sheet gloss profile and smoothness distribution in the CD. Thus a number of profiling systems have been developed to offer control of the paper quality during paper production.

Steam showers are conventional profiling systems that work by selectively delivering steam onto the paper web during production. Profiling steam showers deliver a variable distribution of steam in zones across the paper web. The amount of steam passing through each zone of a steam shower is adjusted through an actuator located in that zone.

Steam showers are widely used on the Fourdrinier table to help drainage and increase production. In the press section, steam is added before the press nips to increase the temperature of the web. The added temperature makes the water removal by pressing much more effective as the added moisture removal is much greater than the added moisture due to steam condensation. Profiling steam showers are also used in the calendering process to improve gloss and smoothness of the paper products.

Moisture spray systems are also conventional profiling systems normally used in the evaporating sections of paper machines. The water spray systems are designed to apply a profile of moisture spray in the cross-machine direction to counter an undesirable moisture profile in the paper web. These systems consist of a series of flow-controlling actuators capable of independently adjusting the amount of spray in discrete adjacent zones in the CD.

In addition to the actuator, another key component in moisture spray systems is the spray nozzle. The nozzle is the device that breaks the water particles into fine droplets. These nozzles typically use a separate air pressure line to produce the droplets.

Steam showers basically add moisture and heat to the web by impinging hot steam on to the surface of paper. The latent energy in the steam is released when steam condensation occurs on the paper surface, and causes the web temperature to rise. Steam condensation continues until a certain temperature on the paper surface is reached. Higher web temperature implies less viscosity of the moisture, and consequently less resistance to the dewatering of the press section. It is the added heat that contributes to the improvement of machine runnability and efficiency, and consequently to the increase of the paper production.

Profiling steam showers are also used to improve moisture content in the web. However the resulting benefits are limited due to the capability of the paper sheet to condense steam on to its surface. As mentioned before, steam will not condense on the paper surface if the surface temperature is too high, instead it bounces back into the environment and is wasted.

Water spray systems directly add moisture to the paper surface to improve the moisture profile. Before spraying water to the web, the water is normally heated to the temperature of the web to prevent any by-effects due to the temperature disturbance. Compared to steam shower systems, water spray systems have more freedom for moisture manipulation. However the water spray systems have limited effects on the temperature rise of the web. Therefore, water sprays are generally used for quality improvements while steam showers are used for improving both production and quality.

The apparatus and method of the present invention was developed in order to overcome the shortcomings of both steam showers and water spray systems. The present invention combines the advantages of steam showers with that of water spray systems. The method involves impinging a predetermined mixture of steam and spray on to the web for both production and quality improvement. The predetermined mixture contains carefully calculated moisture and heat for a specific application without the limits arising from only a steam shower or only a water spray.

The novel apparatus involves using existing actuator nozzle modules that are able to use steam to break water into fine droplets. The actuator controls the moisture content in the mixture. The heat of the mixture can be controlled by adjusting the steam pressure and the amount of superheating of the steam.

Typically, there are two types of actuators that can be used in the apparatus of the present invention. One converts a control signal to a linear movement. The linear movement is then employed to adjust proportionally an opening area in a valve mechanism. The flow amount passing through this valve is therefore controllable in a linear fashion by keeping the upstream flow pressure constant, and the varying opening area at the valve determines the flow rate.

The other actuator type is referred to as the regulator type. The regulator-type actuator regulates the flow pressure feeding a constant opening based on a controlling reference pneumatic pressure. The varying pressure feeding the constant orifice determines the flow rate.

The regulator-type actuator is especially effective for applications requiring small flow control. It can be appreciated that precisely adjusting the opening of a small orifice is very difficult. Thus it is much easier to keep the opening of the small orifice untouched while regulating the flow pressure feeding that orifice. Another advantage of the regulator type actuator is its capability to fully close the valve when needed. Therefore the regulator-type actuator is used for the novel apparatus of the present invention because of its superior performance.

SUMMARY OF THE INVENTION

A method of wetting and heating webs of paper or other hygroscopic material. The method comprises:

(a) supplying a steam stream that is the combination of a swirling steam stream, one straight steam stream and another straight steam stream;

(b) providing a mixture of a liquid atomized by said supplied steam stream and said steam stream, said mixture having both moisture and heat; and (c) absorbing in a web of hygroscopic material advancing across the mixture of said atomized liquid and said steam stream said mixture moisture and heat.

A method of wetting and heating webs of paper or other hygroscopic material using an atomizing nozzle. The method comprises:

(a) forming in the nozzle a steam stream that is the combination of a swirling steam stream, one straight steam stream and another straight steam stream;

(b) providing a mixture of a liquid atomized by said formed steam stream and said steam stream, said mixture having both moisture and heat; and (c) absorbing in a web of hygroscopic material advancing across the mixture of said atomized liquid and said steam stream said mixture moisture and heat.

A method of wetting and heating webs of paper or other hygroscopic material. The method comprises:

(a) arranging at least first and second atomizing nozzles in an array wherein the at least first and second nozzles are adjacent to each other;

(b) forming in each of the at least first and second nozzles a steam stream that is the combination of a swirling steam stream, one straight steam stream and another straight steam stream;

(c) providing to each of said at least first and second nozzles a mixture of a liquid atomized by said formed steam stream and said formed steam stream, said mixture having both moisture and heat; and (d) absorbing in a web of hygroscopic material advancing across the mixture of said atomized liquid and said steam stream said mixture moisture and heat.

A method of wetting and heating webs of paper or other hygroscopic material using an atomizing nozzle. The method comprises:

(a) creating an array of the atomizing nozzles;

(b) forming in each of the nozzles a steam stream that is the combination of a swirling steam stream, one straight steam stream and another straight steam stream;

(c) providing to each of said nozzles a mixture of a liquid atomized by said formed steam stream and said formed steam stream, said mixture having both moisture and heat; and (d) absorbing in a web of hygroscopic material advancing across the mixture of said atomized liquid and said steam stream said mixture moisture and heat.

An apparatus for atomizing a liquid with steam. The apparatus comprises:

(a) a housing having a steam discharging outlet and a liquid discharging outlet aligned flush with each other;

(b) a first nozzle in the housing for producing at the steam discharging outlet and along a predetermined axis a steam stream that is the combination of a swirling steam stream, one straight steam stream and another straight steam stream;

(c) a second nozzle disposed in said first nozzle for producing at said liquid discharging outlet a controlled stream of liquid, said steam stream atomizing said stream of liquid external to said housing; and (d) a steam stream divider disposed in the first nozzle and outside of the second nozzle, the steam stream divider maintaining the concentricity of the steam stream and the controlled liquid stream.

An apparatus for atomizing a liquid with steam. The apparatus comprises:

(a) a first nozzle for producing in the apparatus and along a predetermined axis a steam stream that is the combination of a swirling steam stream, one straight steam stream and another straight steam stream;

(b) a second nozzle disposed in the first nozzle for producing in the apparatus a controlled stream of liquid, the steam stream atomizing the stream of liquid external to the apparatus; and (c) a steam stream divider disposed in the first nozzle and outside of the second nozzle, the steam stream divider maintaining the concentricity of the steam stream and the controlled liquid stream.

An apparatus comprising:

one or more nozzles, each of the nozzles atomizing a flow of liquid by a steam stream that is the combination of a swirling steam stream, one straight steam stream and another straight steam stream to thereby provide both moisture and steam to a web of hygroscopic material.

DESCRIPTION OF THE PREFERRED EMBODIMENTS

Figure 1:
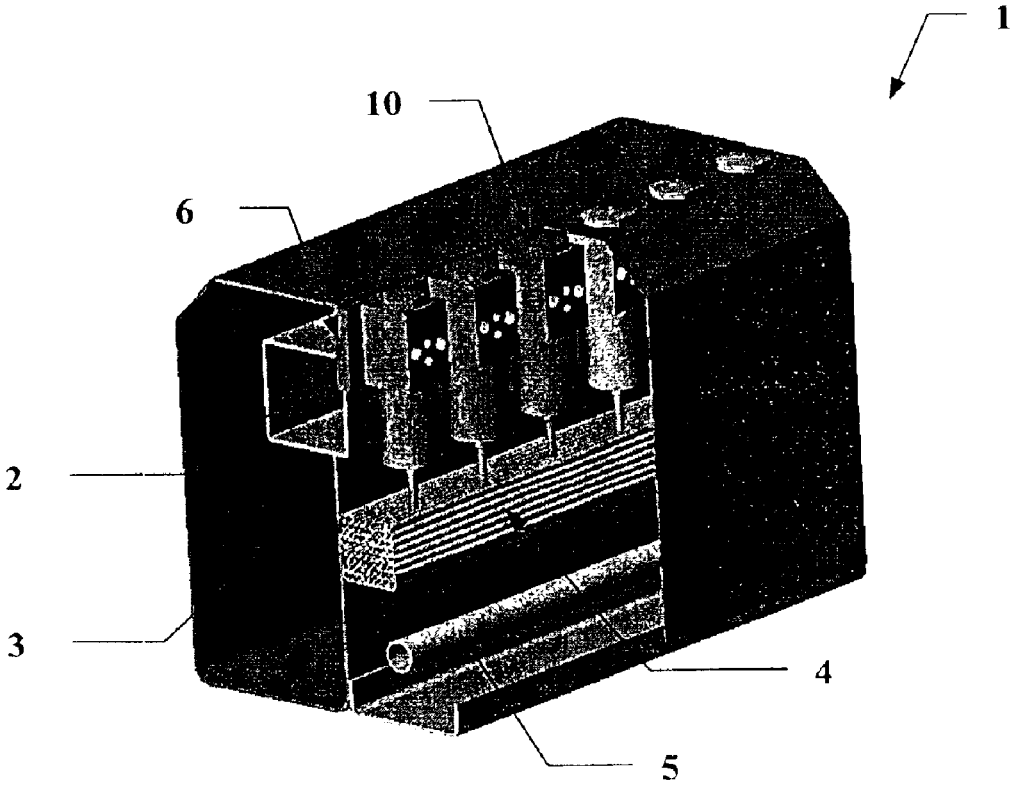
FIG. 1 shows a segment of the preferred embodiment for the steam water spray of the present invention.

FIG. 1 shows a segment of the preferred embodiment for the steam water spray system 1 of the present invention.

System 1 consists of a plurality of actuator nozzle modules 10 mounted on a plate 6 across the paper web in the CD. A common water chamber 2 in sealed communication with a water supply unit (not shown) feeds pressurized water to each actuator nozzle module 10 through a hole (not shown) in the plate 6. A water return pipe 5 recycles unused water back to a water tank (not shown) of the water supply unit. A common steam chamber 3 in sealed communication with a steam preparation system (not shown) feeds pressurized steam to each actuator nozzle module 10 through another hole (not shown) in the plate 6. A remotely generated pneumatic signal of 6 PSIG to 30 PSIG sent through air tubes 4 controls the water volume flow passing through each actuator nozzle module 10.

Figure 2:
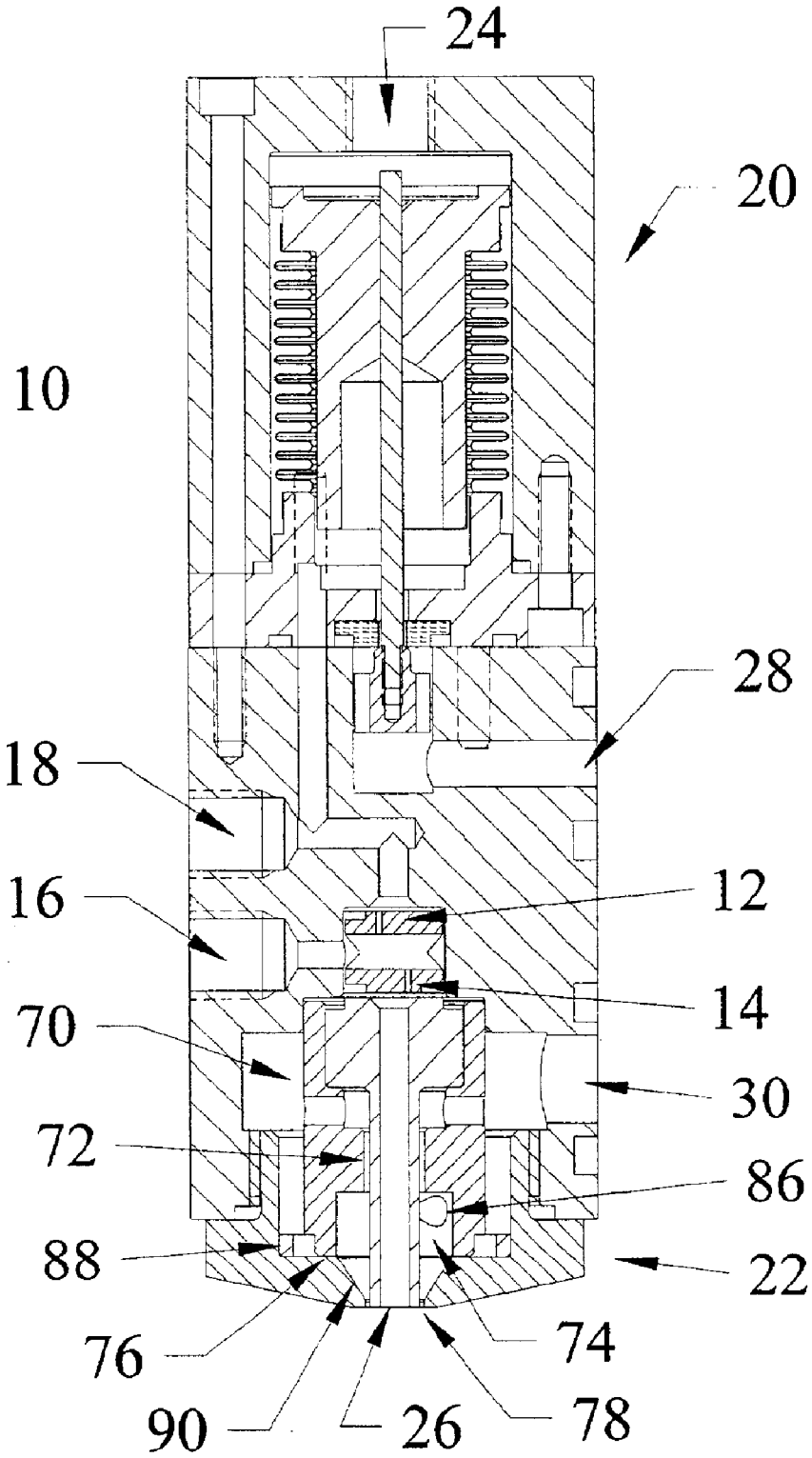
FIG. 2 shows an actuator nozzle module that is used in the preferred embodiment of FIG. 1.

Referring now to FIG. 2 there is shown an embodiment for integrated actuator nozzle module 10. Module 10 consists of an atomizing nozzle 22 and a regulator-type actuator 20. Nozzle 22 includes a port 28 which is in sealed communication with the common water chamber 2 through the plate 6 of FIG. 1. The port 28 receives pressurized water from the water chamber 2 and then feeds that water to the regulator type actuator 20.

The actuator 20 regulates the water pressure between 0 PSIG and 24 PSIG feeding a pair of orifices 12 and 14 and a water nozzle 26 downstream of the orifices. The feeding pressure and the sizes of the orifices 12 and 14 and the water nozzle 26 fully determine the water volume flow through the module 10.

There are two pressure ports 18 and 16 in the water passage. The pressure port 18 is located upstream of the pair of orifices 12 and 14, while the other port 16 is linked to the space between the two orifices 12 and 14. The pressure measurements at the two pressure ports 16 and 18 can, as will be described below, be used to monitor the status of the two orifices 12 and 14 and the water nozzle 26.

Preferably, steam is feed into a channel 70 of the atomizing nozzle 22 through a port 30 which is in sealed communication with the common steam chamber 3 through the plate 6 of FIG. 1. Steam in the channel 70 then splits into three streams: one stream through a circumferential gap 72 around the water nozzle 26, another stream through a flat gap 76 adjacent to the nozzle exit, and yet another stream through two off-center orifices 86. The separated streams then mix again in a mixing chamber 74 before emitting to the environment through an annulus 78 around the water nozzle 26. Steam passing through the two off-centered orifices 86 in opposite directions creates a swirling component of the mixed flow in the mixing chamber 74. This swirling component does not exist in conventional steam showers.

When the valve of the actuator 10 is fully closed, there is no water flow through the nozzle 22 and the actuator module 10 delivers only steam to the web. As is described below in connection with FIG. 3 which shows a preferred embodiment for the regulator type actuator 20, a valve stem 46 which is attached to a piston 44 combined with a valve seat 48 forms a valve at the source water inlet.

The steam water spray system 1 of the present invention is superior to conventional steam showers, because of the added swirling component in the steam jet. The swirling movement allows the steam to easily penetrate the boundary layer formed by the air carried by the moving web. Improved contact between the steam and the paper surface increases the efficiency of the steam treatment.

When the valve of the actuator 10 opens, water passing the valve feeds into the water nozzle 26. The steam jet emitting through the annulus 78 acts as atomizing fluid in this case. The use of the combination of three steam streams in the mixing chamber 74 before emitting steam to the environment results in a moisture distribution that is mostly suitable to the profiling applications. Another benefit of the three atomizing streams is that the resulting size of the water droplets are effectively appropriate for paper rewet application. It is found that the three-stream atomizing nozzle can produce averaged droplets as small as 50 microns.

Alternatively, a plurality of steam valves upstream of the port 30 (not shown) can be used to regulate the steam volume flow feeding the atomizing nozzle 22. This configuration allows, as does conventional steam showers, temperature profiling across the web in the CD. However, the added water associated with the present invention extends the range of moisture manipulation of a conventional steam shower. The capability of regulating steam volume flow also adds size control to droplets produced by the atomizing nozzle. As is well known, the more the atomizing fluid flow, the smaller the droplets produced by an atomizing nozzle.

The steam atomizing of the present invention provides when compared to air atomizing benefits to the spray system. As is well known the large water volume flow for heavy grade paper requires more atomizing fluid flow to atomize the water. For a nozzle with fixed geometry, more atomizing flow indicates a higher atomizing pressure. It is much more expensive to compress air to a pressure higher than 15 PSIG, because of the difference in cost between the air blower that is capable of compressing the air up to 15 PSIG and the compressor needed to compress the air to pressures higher than 15 PSIG. However, steam with a pressure higher than 15 PSIG is readily available in any paper mill.

Another benefit of using steam to atomize water is the expected reduction in droplet size. Latent energy in the steam heats the atomized water and consequently reduces the viscosity of the water. Lower viscosity results in smaller resistance to the atomizing process and therefore smaller droplets in the spray.

The regulator-type actuator 20 of FIG. 2 is described in commonly owned U.S. Pat. No. 6,394,418 for "Bellows Actuator for Pressure and Flow Control", the disclosure of which is incorporated herein by reference.

Figure 3:
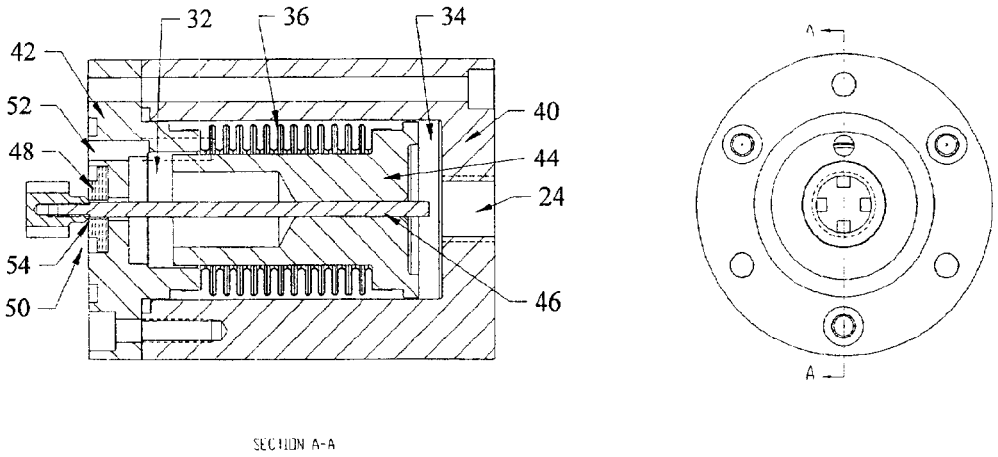
FIG. 3 shows an embodiment for the regulator type actuator that is part of the actuator nozzle module of FIG. 2.

Referring now to FIG. 3 there is shown an embodiment for the regulator-type actuator 20.

Actuator 20 consists of an internal chamber 32 and an external chamber 34 separated by a flexible metal bellows 36. The external chamber 34 is the space formed by actuator body 40, the bellows 36, the end piece 42 and the piston 44. The control air inlet 24 feeds into the external chamber 34. The internal chamber 32 is the space formed by the water inlet end piece 42, the bellows 36 and the piston 44. The source water inlet 50 in sealed communication with the water port 28 of FIG. 2 feeds into the internal chamber 32. A valve stem 46 attached to the piston 44 combined with a valve seat 48 forms a valve at the source water inlet 50. A spray water outlet 52 directs the water to the double orifices 12 and 14 and the nozzle orifice 26 through the water inlet 62 of FIG. 4.

Initial setup of the actuator 20 involves compressing the metal bellows 36 a predetermined amount and attaching the valve stem 46 such that the valve orifice 54 is closed at this pre-compressed setting. In addition, the water inlet end piece 42 and the piston 44 are designed to diametrically guide each other in their relative movement as well as act as an anti-squirm guide for the bellows 36.

The actuator 20 works to control the pressure fed to the double orifices 12 and 14 and the nozzle orifice 26 using the pneumatic control air pressure at the port 24 as a reference. Source water is fed to the source water inlet 50 at a pressure in excess of the maximum desired pressure for the spray nozzle 22. Control air is fed to the metal bellows 36 through actuator body 40.

The air pressure in the external chamber 34 acts against the effective area of the bellows 36 and creates an operating force, which is resisted by three opposing forces. The first opposing force is formed by the spring action of the pre-compressed metal bellows 36. The second opposing force is formed by the pressure of the source water acting against the relatively small area of the valve orifice 54 opening. The third opposing force is formed by the spray water pressure in the internal chamber 32 acting against the effective area of the bellows 36. The first two reactive forces are substantially small or constant which allows changes to the control air pressure to predictably affect the pressure of the water feeding the double orifices 12 and 14 and the nozzle orifice 26. The actuator 20 operates on a balance of these forces.

If the control air pressure is less than the kickoff pressure of 6 PSIG, determined by the amount of pre-compression of the bellows 36, the valve stem 46 remains against the valve seat 48 and no water passes through the valve orifice 54. The double orifices 12 and 14 and nozzle orifice 26 downstream receive no water pressure to feed them.

When the control air pressure exceeds the kickoff pressure of the actuator 20, the valve stem 46 is pushed down by the piston and water flows through the valve orifice 54 into the internal chamber 32 and out to the double orifices 12 and 14 and nozzle orifice 26. The double orifices 12 and 14 and the nozzle orifice 26 downstream allow water flow through it but also offer resistance to such flow. Thus the pressure in the internal chamber 32 builds.

As the pressure in the internal chamber 32 increases, the sum of the opposing forces increase until it matches the force of the control air pressure in the external chamber 34. A balance point between control force and reactive opposite force results in regulated water pressure of between 0 PSIG and 24 PSIG, proportional to the pneumatic control pressure of between 6 PSIG and 30 PSIG. The regulated water pressure and the size of the double orifices 12 and 14 determine the flow rate passing through the actuator nozzle module.

A brief description of the mechanism of the actuator nozzle modules 10 is needed before one can fully understand how the actuator nozzle module 10 works. The atomizing nozzle 22 used in module 10 is described in U.S. patent application Ser. No. 10/001,408 ("the '408 Application") filed on Oct. 22, 2001 for "Spraying Nozzle For Rewet Showers", the disclosure of which is incorporated herein by reference. The atomizing nozzle 22 uses a combination of three air streams to break the water into small droplets and produce an appropriate moisture profile that is suitable for paper quality improvement applications.

Figure 4:
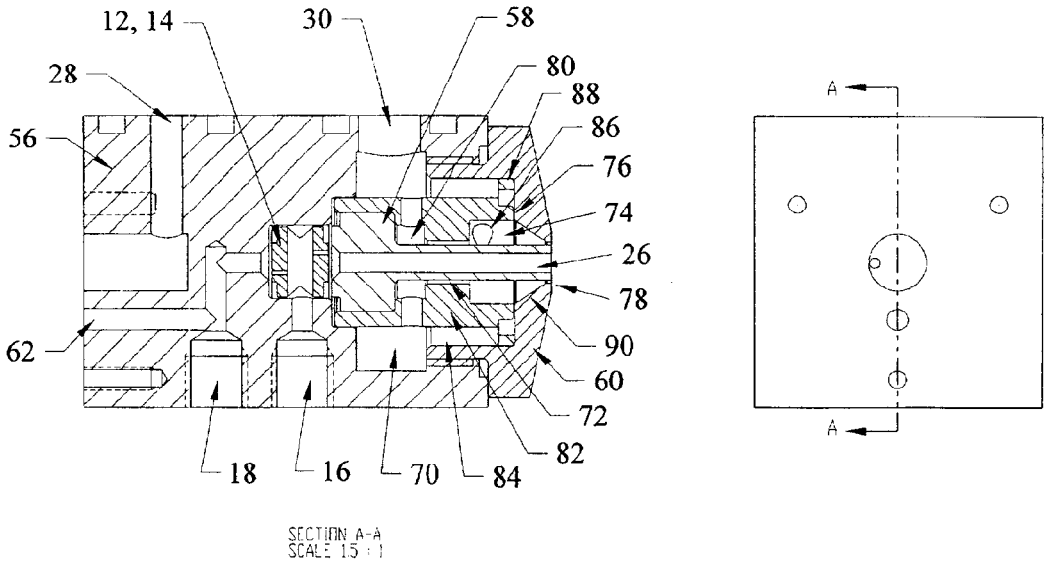
FIG. 4 shows an embodiment for the nozzle portion of the actuator nozzle module of FIG. 2.

Referring now to FIG. 4, there is shown an embodiment for the nozzle portion 22 of the actuator nozzle unit 10. The nozzle portion consists of a nozzle body 56, a double orifice device 12 and 14, a water nozzle tube 58, a stream divider 82 and a steam cap 60. The nozzle body 56 also serves as a mounting base for the actuator 20. The source water inlet 28 on the nozzle body 56 is connected to the source water inlet 50 of FIG. 3 to the actuator 20. The spray water outlet 52 from the actuator 20 of FIG. 3 is aligned with the regulated water inlet 62 on the nozzle body 56. Water from the actuator 20 feeds into the water inlet 62, passing through the double orifices 12 and 14, and finally emits from the water nozzle 26.

Figure 5:
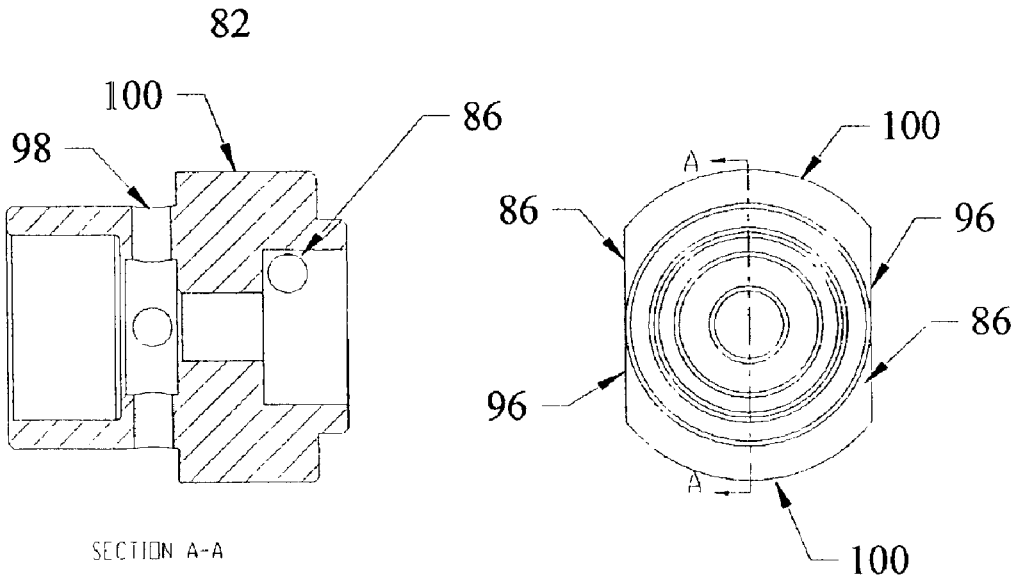
FIG. 5 shows an enlargement of the stream divider of FIG. 4 for the steam-atomizing nozzle.

Atomizing steam feeds into the steam chamber 70 formed by the nozzle body 56, the water tube 58, the stream divider 82 and the steam cap 60 through the atomizing steam inlet 30. The atomizing steam in the steam channel 70 is then separated into three different flow streams by using the cylindrical stream divider 82 an enlargement of which is shown in FIG. 5. One of the streams passing through the holes 98 (shown in FIG. 5) drilled towards the central axis of the cylindrical stream divider 82 gets into the chamber 80 formed by the water tube 58 and the stream divider 82. This stream then flows into the gap 72 between the divider 82 and the water tube 58 before it enters the mixing chamber 74 to form the first steam stream around the water tube 58.

There are two flat surfaces 96 (shown in FIG. 5) machined from the cylindrical outer surface of the stream divider 82 and located on one end of the divider 82. The two flat surfaces are located opposite to each other. Two steam channels 84 are formed between the two flat surfaces 96 on the stream divider 82 and the inner surface of the steam cap 60. The two steam channels 84 are connected to the steam channel 70. Atomizing steam in channels 84 are used for the second and the third streams.

The second steam stream passes through the two holes 86 drilled off-center on the two flat surfaces 96 of the stream divider 82 and flows tangentially into the mixing chamber 74. The two off-centered holes 86 are aligned in opposite directions so that swirling flow is produced in the mixing chamber 74 around the first steam stream. The size of the two orifices 86 and the steam pressure in the channel 70 determine the strength of the swirl in the mixing chamber 74. The swirl determines the spray pattern of the final jet, especially the width of the final jet.

The third steam stream is generated by atomizing steam in the two steam channels 84 passing through the gap 76 formed between the steam cap 60 and the steam divider 82. A ring 88 is used to control the width of the gap 76, and consequently the shape of the resulting spray profile. The third stream passes through the gap 76, bends towards the chamfered surface 90 on the steam cap 60 due to the Coanda effect. The Coanda effect indicates that flow tends to attach to a solid surface. The third stream wraps the swirling flow and the first stream within it in the mixing chamber 74. The combination of the three streams rushes out of the annulus 78 around the water jet emitting from nozzle orifice 26.

There are several benefits associated with the design of the three-stream nozzle. One of the benefits is the efficiency of the atomizing nozzle. When the third stream bends at the chamfer 90 of the steam cap 60, an area with low pressure is created near the chamfer 90 of the steam cap 60 also due to the Coanda effect. This low pressure in chamber 74 created by the third stream reduces the resistance on both the first steam stream and the swirling second stream. This reduction of the resistance indicates that exactly the same spray pattern (particle size and mass profile) that is created by the three air streams used in the atomizing nozzle described in the '408 Application can also be created with relatively low atomizing steam source pressure.

Another benefit of the atomizing nozzle design is that the design allows control of the two slopes of the water mass profile generated by the nozzle. The third stream which is a result of the design adds axial momentum to the outer region of the swirl that steepens the two slopes on the outer edges of the profile and makes the profile closer to an ideal square in shape.

Yet another benefit of the atomizing nozzle design arises from the additional shearing force produced by the mixing atomizing steam streams. Larger water particles in the swirl move away from the center of the jet faster due to the greater centrifugal force. The shearing force created in the mixing range of the third stream and the swirl breaks those particles into even smaller particles. The resulting spray has a more uniform particle size distribution across the whole profile.

Still yet another benefit of the nozzle design is also efficiency related. The swirl generated by the two off-centered holes 86 in the mixing chamber 74 is compressed in the convergent area formed by the chamfer 90 on the steam cap 60. The tangential velocity in the swirl increases dramatically during the compression. The chamfer 90 of the steam cap 60 drags the tangential velocity to zero on the chamfer surface. The friction on the chamfer surface dissipates the strength of the swirl and causes inefficiency in the nozzle. The third stream located between the swirl and the chamfer surface acts as a cushion for the swirl and preserves the vortical strength of the swirl.

As was described above, the pressure measurements at ports 16 and 18 in the water passage (see FIG. 2 and FIG. 4) can be used to monitor the status of the flow control orifices 12 and 14 and water orifice 26. This monitoring is described in U.S. Pat. No. 6,460,775, for "Flow Monitor for Rewet Showers" the disclosure of which is incorporated herein by reference.

The monitoring capability of this actuator nozzle unit 10 is achieved by pressure measurement at two pressure ports 16 and 18 of FIG. 2. As is shown in FIG. 2 there is a pressure port 16 located right between the two orifices 12 and 14. There is also another pressure port 18 upstream of the two orifices 12 and 14 that monitors the regulated water pressure from the actuator 20 included in the module 10. The upstream pressure measured is compared with the pneumatic control pressure sent to the actuator 20 through port 24. This comparison results in the performance diagnosis of the actuator 20.

The pressure measured between the two orifices 12 and 14 in combination with the pressure measured upstream can be used to monitor the status of the double orifices 12, 14 and the water orifice 26. Orifice monitoring is achieved by using a double orifice technique. The double orifice technique is based on the fact that there is always a pressure drop when a moving fluid passes an orifice. The pressure change at port 16 between the orifices 12 and 14 is monitored over time comparing to the upstream pressure at port 18. The pressure between the double orifices 12, 14 should be a portion of the upstream pressure, and the ratio of the two pressures is a constant regardless of flow conditions, if there is no geometrical variation in the flow passage.

If the upstream orifice 12 of the double orifices is partially blocked, the measured pressure between the double orifices 12 and 14 will be lower than normal. A zero pressure measurement between the orifices 12 and 14 indicates full blockage at the upstream orifice 12 during normal operation. When wearing occurs to the upstream orifice 12, increasing pressure should be expected between the double orifices 12 and 14. Similarly, a blockage at the downstream orifice 14 or the water nozzle 26 resists the flow more and consequently a higher pressure should occur between the orifices 12 and 14. When the downstream orifice 14 is fully blocked, the pressure between the two orifices 12 and 14 equals the upstream pressure. Downstream orifice wearing results in a pressure drop.

In short, a pressure drop between the orifices 12 and 14 indicates either blockage at the upstream orifice 12 or wearing downstream. Pressure increasing between the orifices 12 and 14 implies that there is either wearing at the upstream orifice 12 or blockage downstream. Although there is no way to tell which orifice has caused the variation in the measured pressure one should be able to conclude that it is time to change the orifices. The double orifices 12 and 14 can be designed as one component for easy replacement.

The nozzle orifice 26, which affects the droplet size from the nozzle 22, is the same for all applications. Orifice diameters of the double orifices 12, 14 determine the maximum water flow capacity for each individual application. For most of the applications, the nozzle orifice 26 is much larger than the flow orifice diameter. Therefore the pressure drop through the water orifice 26 is substantially less than the pressure drop through any one of the two orifices 12, 14. A relatively large pressure value at the port 16 makes precise pressure measurement there easier. That is why the monitoring technique uses two orifices 12, 14 instead of one in the design. In practice, the diameters of the two orifices 12, 14 can be either identical or different.

It is to be understood that the description of the preferred embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A method of wetting and heating webs of paper or other hygroscopic material, comprising:

(a) supplying a steam stream that is the combination of a swirling steam stream, one straight steam stream and another straight steam stream;

(b) providing a mixture of a liquid atomized by said supplied steam stream and said steam stream, said mixture having both moisture and heat; and (c) absorbing in a web of hygroscopic material advancing across the mixture of said atomized liquid and said steam stream said mixture moisture and heat.

2. A method of wetting and heating webs of paper or other hygroscopic material using an atomizing nozzle, comprising:

(a) forming in said nozzle a steam stream that is the combination of a swirling steam stream, one straight steam stream and another straight steam stream;

(b) providing a mixture of a liquid atomized by said formed steam stream and said steam stream, said mixture having both moisture and heat; and (c) absorbing in a web of hygroscopic material advancing across the mixture of said atomized liquid and said steam stream said mixture moisture and heat.

3. The method of claim 2 wherein said providing includes inserting a liquid discharging tube into the path of said formed steam stream so that said formed steam stream surrounds said tube.

4. A method of wetting and heating webs of paper or other hygroscopic material, comprising:

(a) arranging at least first and second atomizing nozzles in an array wherein said at least first and second nozzles are adjacent to each other;

(b) forming in each of said at least first and second nozzles a steam stream that is the combination of a swirling steam stream, one straight steam stream and another straight steam stream;

(c) providing to each of said at least first and second nozzles a mixture of a liquid atomized by said formed steam stream and said formed steam stream, said mixture having both moisture and heat; and (d) absorbing in a web of hygroscopic material advancing across the mixture of said atomized liquid and said steam stream said mixture moisture and heat.

5. A method of wetting and heating webs of paper or other hygroscopic material using an atomizing nozzle, comprising:

(a) creating an array of said atomizing nozzles;

(b) forming in each of said nozzles a steam stream that is the combination of a swirling steam stream, one straight steam stream and another straight steam stream;

(c) providing to each of said nozzles a mixture of a liquid atomized by said formed steam stream and said formed steam stream, said mixture having both moisture and heat; and (d) absorbing in a web of hygroscopic material advancing across the mixture of said atomized liquid and said steam stream said mixture moisture and heat.

6. Apparatus for atomizing a liquid with steam comprising:

(a) a housing having a steam discharging outlet and a liquid discharging outlet aligned flush with each other;

(b) a first nozzle in said housing for producing at said steam discharging outlet and along a predetermined axis a steam stream that is the combination of a swirling steam stream, one straight steam stream and another straight steam stream;

(c) a second nozzle disposed in said first nozzle for producing at said liquid discharging outlet a controlled stream of liquid, said steam stream atomizing said stream of liquid external to said housing; and (d) a steam stream divider disposed in said first nozzle and outside of said second nozzle, said steam stream divider maintaining the concentricity of said steam stream and said controlled liquid stream.

7. Apparatus for atomizing a liquid with steam comprising:

(a) a first nozzle for producing in said apparatus and along a predetermined axis a steam stream that is the combination of a swirling steam stream, one straight steam stream and another straight steam stream;

(b) a second nozzle disposed in said first nozzle for producing in said apparatus a controlled stream of liquid, said steam stream atomizing said stream of liquid external to said apparatus; and (c) a steam stream divider disposed in said first nozzle and outside of said second nozzle, said steam stream divider maintaining the concentricity of said steam stream and said controlled liquid stream.

8. The apparatus of claim 7 further comprising a housing having a steam discharge outlet and a liquid discharge outlet aligned flush with each other, said steam stream atomizing said stream of liquid external to said housing.

9. An apparatus comprising:

one or more nozzles, each of said nozzles atomizing a flow of liquid by a steam stream that is the combination of a swirling steam stream, one straight steam stream and another straight steam stream to thereby provide both moisture and steam to a web of hygroscopic material.

10. The apparatus of claim 9 further comprising a chamber for providing said flow of liquid to all of said one or more nozzles in said array.

11. The apparatus of claim 9 further comprising a chamber for providing a flow of steam to all of said one or more nozzles in said array.

12. The apparatus of claim 9 further comprising a chamber for providing said flow of liquid to all of said one or more nozzles in said array and a chamber for providing a flow of steam to all of said one or more nozzles in said array.

13. The apparatus of claim 9 further comprising a pneumatic signal connected to each of said one or more nozzles for controlling the flow of liquid in each of said one or more nozzles.

* * * * *